US008500464B2

(12) United States Patent
Turco et al.

(10) Patent No.: US 8,500,464 B2
(45) Date of Patent: Aug. 6, 2013

(54) ELECTRIC SMD MALE CONNECTOR AND A METHOD FOR ASSEMBLING THEREOF

(75) Inventors: Giovanni Turco, Turin (IT); Davide Chiarelli, Rivoli (IT)

(73) Assignee: Tyco Electronics AMP Italia SpA, Collegno (Torino) (IT)

( * ) Notice: Subject to any disclaimer, the term of this patent is extended or adjusted under 35 U.S.C. 154(b) by 0 days.

(21) Appl. No.: 13/141,519

(22) PCT Filed: Sep. 23, 2009

(86) PCT No.: PCT/IB2009/054166

§ 371 (c)(1),
(2), (4) Date: Jun. 22, 2011

(87) PCT Pub. No.: WO2010/073131

PCT Pub. Date: Jul. 1, 2010

(65) Prior Publication Data

US 2011/0256781 A1 Oct. 20, 2011

(30) Foreign Application Priority Data

Dec. 23, 2008 (IT) ..... TO2008A0974

(51) Int. Cl.
*H01R 12/00* (2006.01)

(52) U.S. Cl.
USPC ..... 439/79

(58) Field of Classification Search
USPC ..... 439/79, 692, 678, 699.1, 541.5, 620.12, 439/620.16
See application file for complete search history.

(56) References Cited

U.S. PATENT DOCUMENTS

| | | | | | |
|---|---|---|---|---|---|
| 4,697,864 | A | * | 10/1987 | Hayes et al. | 439/692 |
| 4,846,711 | A | | 7/1989 | Kobler et al. | |
| 4,921,431 | A | * | 5/1990 | Garay et al. | 439/79 |
| 5,186,633 | A | * | 2/1993 | Mosser, III | 439/79 |
| 5,735,042 | A | | 4/1998 | Takano et al. | |

FOREIGN PATENT DOCUMENTS

| | | | |
|---|---|---|---|
| DE | 19753839 | C1 | 4/1999 |
| EP | 1 107 373 | A2 | 6/2001 |
| FR | 2874753 | A | 3/2006 |

OTHER PUBLICATIONS

International Search Report and Written Opinion, issued by the European Patent Office, dated Dec. 15, 2009, for International PCT Application No. PCT/IB2009/054166; 12 pages.
Search Report issued by Ministero dello Sviluppo Economico (Ministry of Economic Development, Italian Patent & Trademark Office), dated May 25, 2009 for Italian Patent Application No. IT TO20080974; 8 pages.

* cited by examiner

*Primary Examiner* — Felix O Figueroa
(74) *Attorney, Agent, or Firm* — Faegre Baker Daniels LLP

(57) ABSTRACT

An electric SMD connector comprises a body of plastic material (2) having a base lower surface (2*a*) which is substantially planar, to which there is associated a metal plate (4) for soldered connection to a printed circuit board (B). A plurality of metal contacts (3) carried by the body of the connector have front end portions (3*a*) for coupling with the contacts of a female connector and projecting from a front surface (2*c*) of the body of the connector, parallel to, and spaced apart from, the lower surface 2*a*. The contacts further comprise rear end portions (3*b*) which project from a rear surface (2*e*) of the body of the connector, in a plane substantially coincident with the plane of said lower surface (2*a*). The front end portions (3*a*) of the contacts are in a circumferential arrangement which is oriented so that the theoretical projections of said contacts (3) on the plane of said base lower surface (2*a*) are substantially equally spaced from each other, so that the rear end portions (3*b*) of the metal contacts (3) are also equally spaced from each other.

9 Claims, 6 Drawing Sheets

ELECTRIC SMD MALE CONNECTOR AND A METHOD FOR ASSEMBLING THEREOF

FIELD OF THE INVENTION

The present invention relates to an electric surface mount device (SMD) male connector comprising:

- a body of plastic material, having a substantially planar base lower surface, to which a metal plate is associated for a soldered connection to a printed circuit board,
- a plurality of metal contacts, carried by the body of the connector and having:
  - front end portions, for mating with the contacts of a female connector, said front end portions projecting from a front surface of the body of the connector, parallel to, and spaced apart from, said lower surface, and
  - rear end portions, which project from a rear surface of the body of the connector, in a plane substantially coincident with the plane of said lower surface and along directions parallel to each other.

BACKGROUND OF THE INVENTION

A connector having features similar to those indicated above is known from DE 197 53 839 C1. From EP 107 373 A2 a connector is also known having four metal contacts with front end portions staggered in two planes so that the opposite end portions of the contacts are arranged in line, with a constant pitch.

The object of the present invention is that of providing an electric connector of the above indicated type which has a relatively simple and inexpensive structure, which is in particular quick and simple to manufacture and assemble and which also can be placed into operation in a simple and quick manner.

SUMMARY OF THE INVENTION

In view of achieving this object, the invention provides an electric connector having the features which have been indicated in the foregoing and further characterized in that said front end portions of the metal contacts are equally angularly spaced along a circumference and are oriented so that each of the front portions of the contacts is at a different distance from the base surface and so that the theoretical projections of said front portions of the contacts on the plane of said base lower surface are substantially equally spaced from each other, whereby said rear end portions of the metal contacts are also equally spaced from each other.

In this manner a compact circular connector arrangement is obtained, while ensuring the SMD contacts to be in line at the same distance.

In the preferred embodiment, the above mentioned metal contacts are comprised of bent elements of sheet metal arranged in parallel and equally spaced planes orthogonal to said base lower surface and each element including an intermediate connecting portion between the front end portion and the rear end portion.

Also in the case of the above mentioned preferred embodiment, each metal contact is constituted by a planar and elongated strip of metal sheet and the front end portion of each contact has a configuration in form of a cylindrical pin, which is obtained by transversally bending and shaping the front portion of the above mentioned planar strip.

Also in the case of the above mentioned preferred embodiment, the body of the connector includes a wall whose opposite surfaces define the above mentioned front surface and rear surface. This wall has a plurality of through apertures for engagement of the metal contacts, so that each contact has its pin-shaped front end portion which is in abutment against a stop surface of said wall and extends with its intermediate portion through the respective aperture until it exits on the rear surface of the connector body, where the body of the contact is bent towards the base surface of the connector body, and then again in the plane of said base surface, so as to define the respective rear end portion of the contact.

The present invention is also directed to a method according to claim 9.

Due to the above described orientation of the circumferential arrangement of the contacts of the connector it is possible to obtain, with simple means and rapidly, a connector which has the desired features and adapted to be placed into operation also in a simple and rapid manner.

The number of the contacts provided in the connector may be any. In the case of a connector actually made by the applicant/assignee, in which the contacts are in the number of four, the above described condition of equal distance between the projections of the contacts over the planar base surface of the connector body implies that the four contacts, viewed from the front, are at the apices of a theoretical square whose diagonals are inclined with respect to a vertical or horizontal direction, by an angle substantially corresponding to the arch tangent of ⅓, which with an approximation of 1/1000 is 18.435°. In a real case, given the tolerances of manufacture, it has been considered the value 18.45° for the above mentioned angle as being acceptable. Obviously, if the number of contacts were different, also the value of this angle would change accordingly.

BRIEF DESCRIPTION OF THE DRAWINGS

Further features and advantages of the invention will become apparent from the description which follows with reference to the annexed drawings, given purely by way of non limiting example, in which.

DETAILED DESCRIPTION OF THE INVENTION

Figure 1:
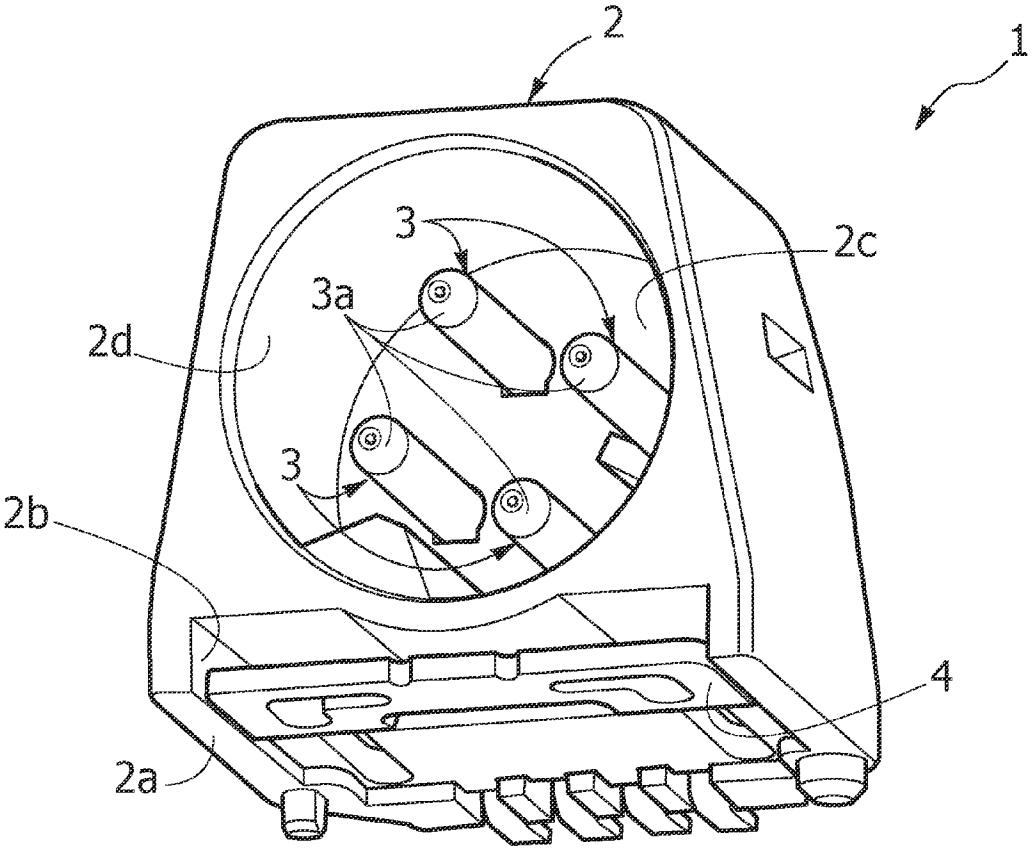
FIGS. 1,2 show a front perspective view and a rear perspective view of a preferred embodiment of the electric connector according to the invention.
Figure 2:
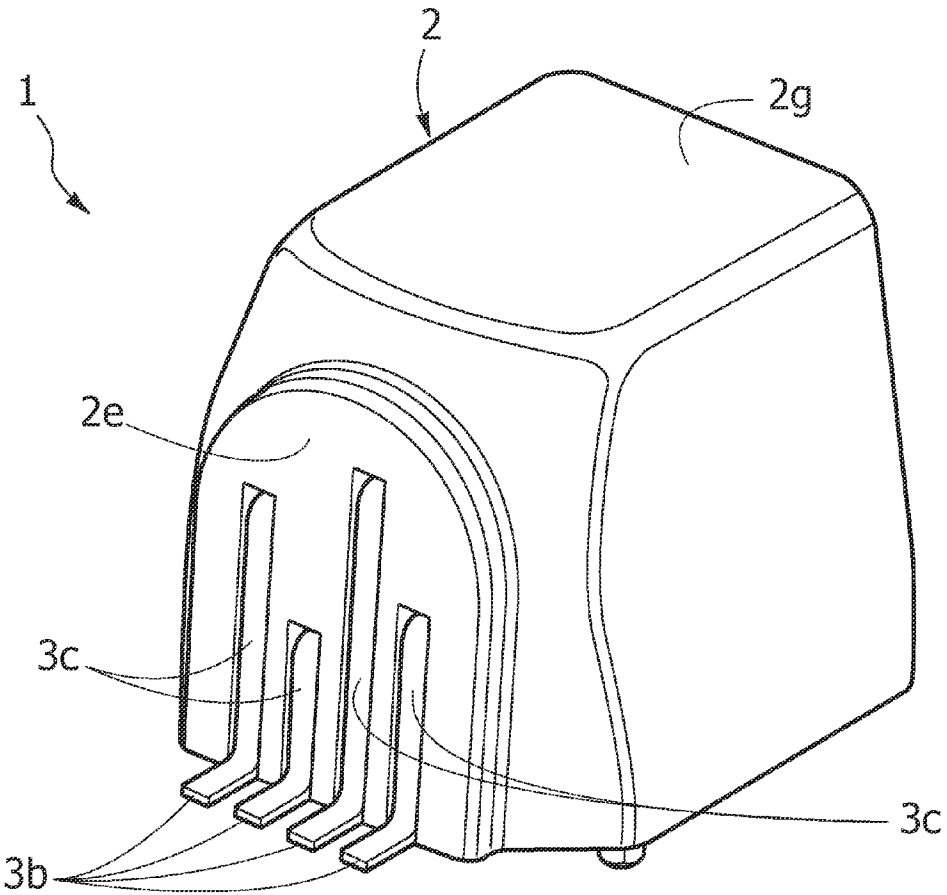
Figure 3:
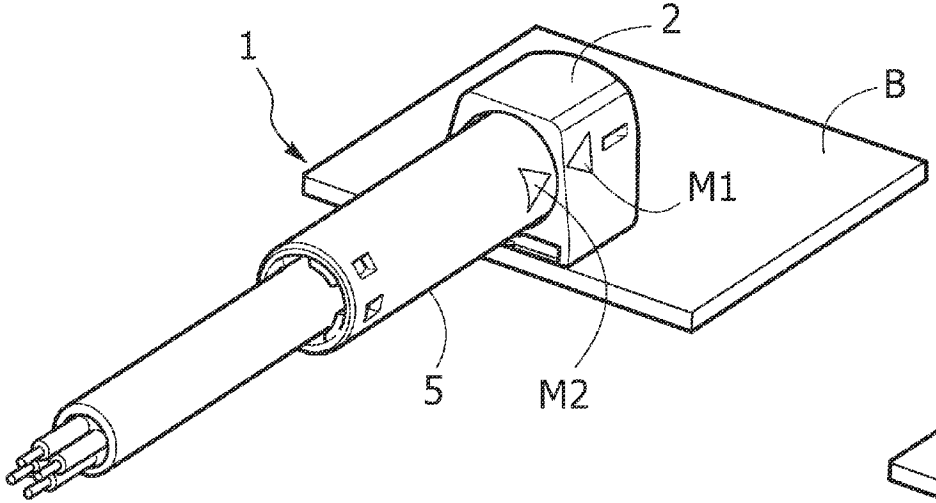
FIGS. 3,4 and 5,6 are front and rear perspective views which show the connector of FIGS. 1,2 in the coupled and uncoupled conditions with respect to a female connector.
Figure 4:
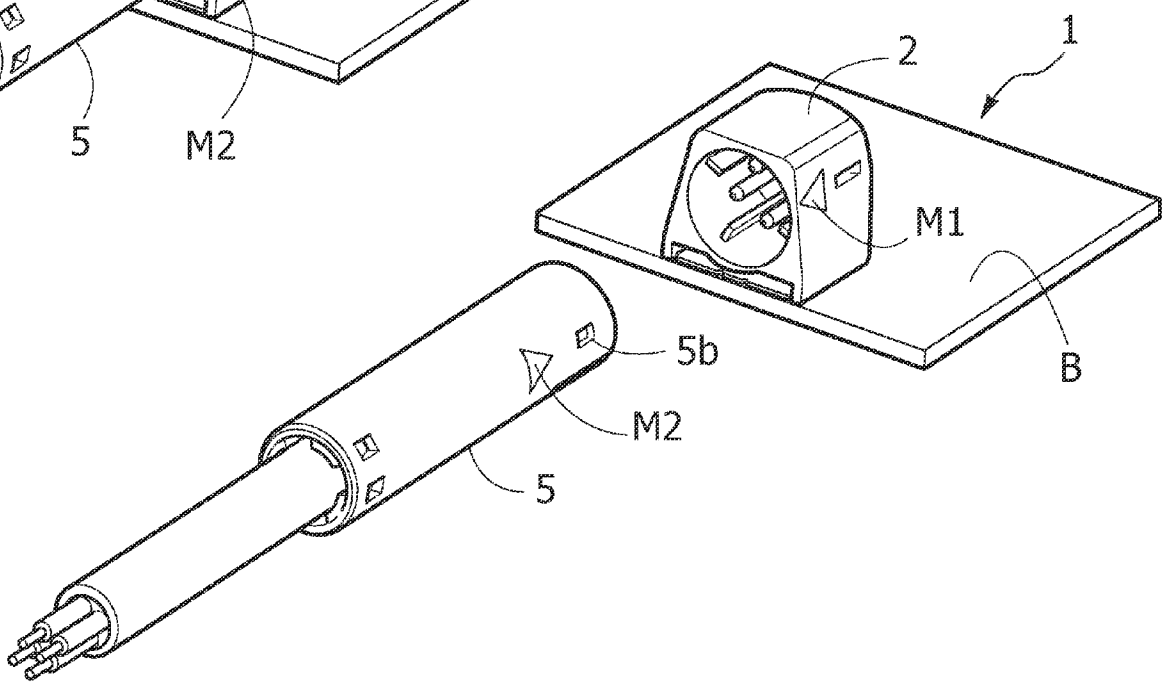
Figure 5:
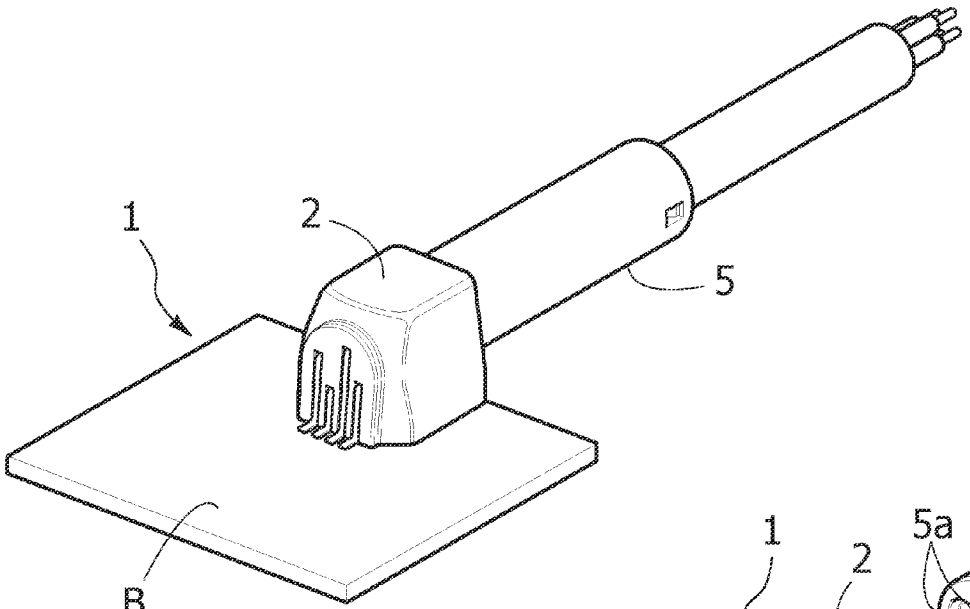
Figure 6:
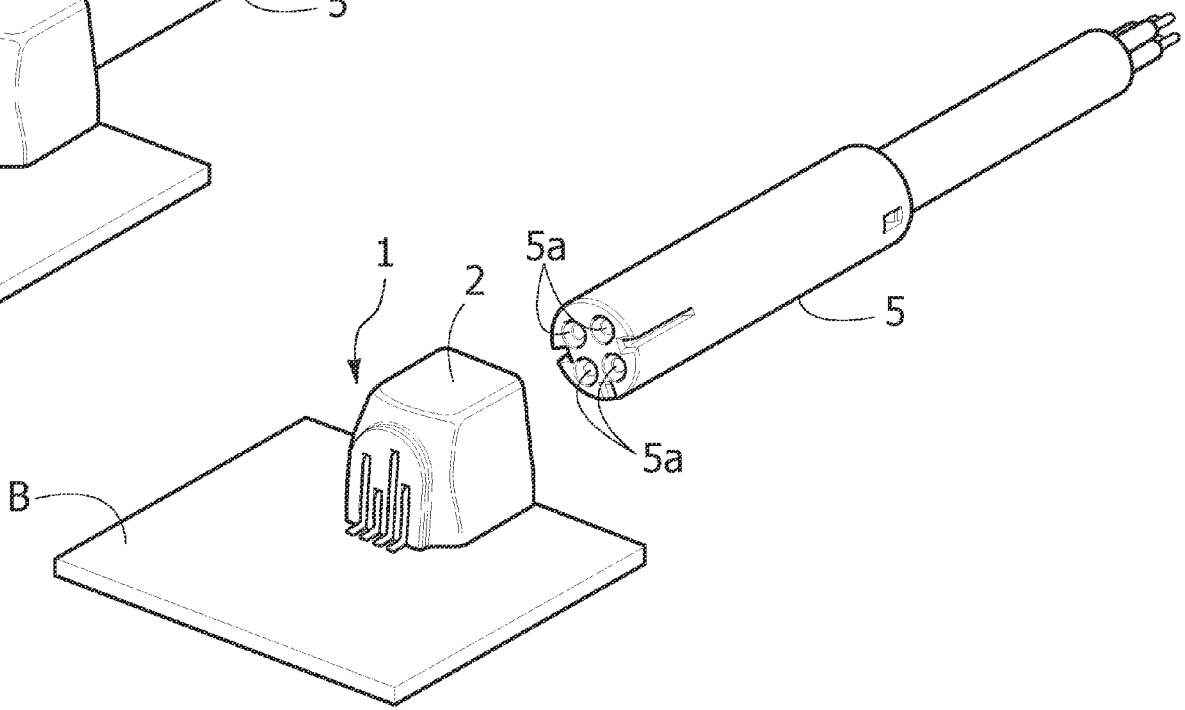
Figure 8:
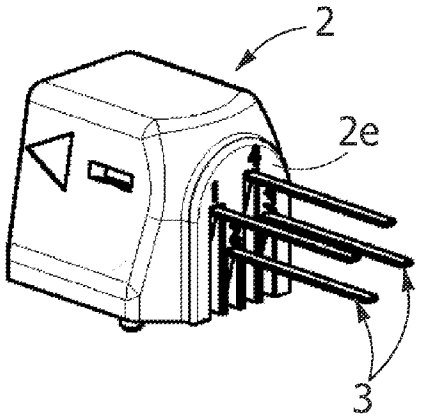
FIGS. 7-10 are diagrammatic perspective views which show the different stages of the assembling of the contacts in the body of the connector according to the invention.
Figure 10:
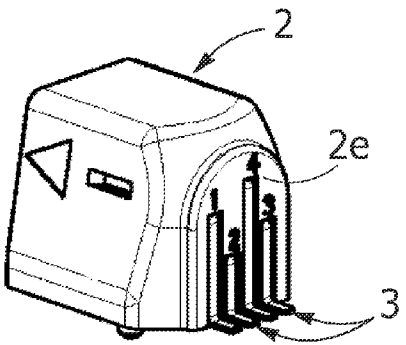
Figure 7:
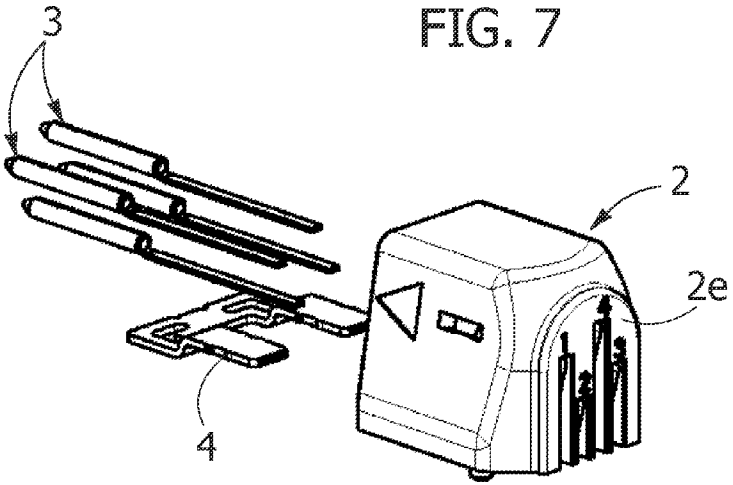
Figure 9:
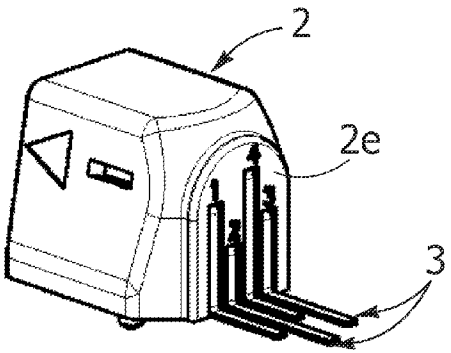
Figure 12:
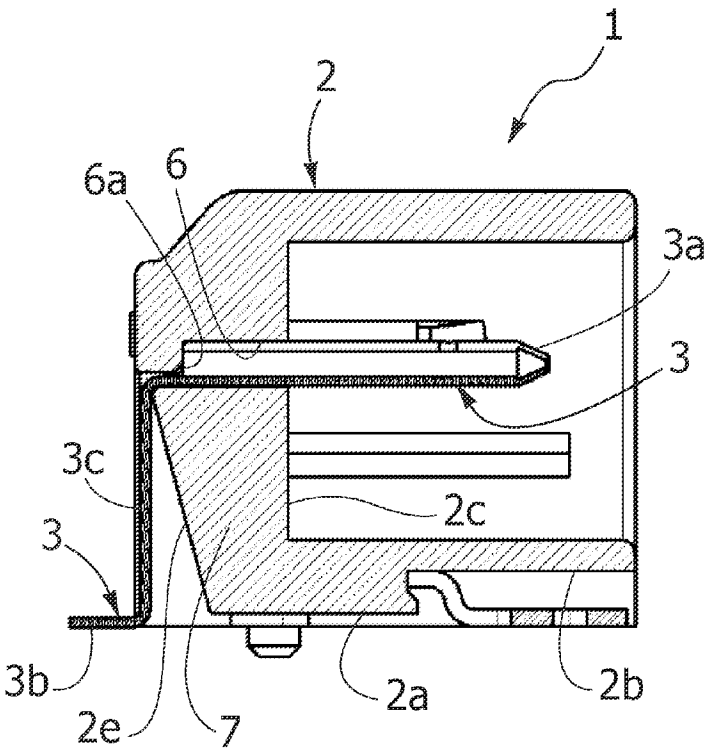
FIG. 12 is a cross-sectional view taken along line XII-XII of FIG. 11.

With reference to the drawings, numeral 1 generally designates an electric SMD male connector having a body 2 of plastic material carrying a plurality of metal contacts 3 (four contacts in the specific case). The body 2 of plastic material has a base lower surface 2*a* which is substantially planar and is to be supported on the surface of a printed circuit board B, diagrammatically shown in FIGS. 3-6. The lower surface 2*a* is configured with a seat 2*b* shaped for receiving and holding a metal plate 4, which is for soldered connection to the board B. In FIG. 1, by 3*a* there are designated the front end portions of the contacts 3, which are configured as cylindrical pins, projecting from a front surface 2*c* of the body 2 of the connector. In the case of the illustrated embodiment, the front surface 2*c* is defined by the bottom surface of a receptacle 2*d* which is formed frontally in the body of the connector and is for receiving the cylindrical body 5 of a further electric connector (see FIGS. 3-6), which does not form part of the present invention and has female contacts 5*a* which are for coupling with the male contacts 3 of the connector 1. FIGS. 4, 6 of the annexed drawings show the connector 1 and the female connector 5 in the uncoupled condition, whereas FIGS. 3, 5 show these connectors in the coupled condition. With reference to FIG. 3, the two connectors have outer surfaces bearing indicia M1, M2 acting as a reference of the proper coupling position. Also with reference to FIGS. 1, 2 and FIGS. 11, 12, each of the metal contacts 3 is defined by a planar and elongated strip of metal sheet having a front end portion 3*a* in which the strip is transversely bent and shaped so as to define a cylindrical pin configuration. Each contact 3 is inserted in an initially straight condition through a respective aperture through a wall 7 of the body 2 of the connector whose opposite surfaces respectively define the front surface 2*c* and the rear surface 2*e* of the body of the connector. In the above mentioned originally straight condition (see also FIG. 7) the contacts 3 are inserted through the apertures 6, from the side of the front surface 2*c*, by using the rear end portions 3*b* of the contacts as leading portions. In this stage (see FIG. 7) also plate 4 is inserted within seat 2*b* of the base lower surface 2*a* of the body of the connector. The contacts 3 are inserted through the apertures 6 until they abut with their cylindrical shaped portions against stop surfaces 6*a* (FIG. 12) formed in the apertures 6. In this condition, these cylindrical portions are held by friction, with an interference feet, within the respective seats. Also in this condition, the rear portion of each contact projects through the aperture 6 from the rear surface 2*e* of the connector body (see also FIG. 8). At this point, the portions of the contacts 3 projecting from the rear surface 2*e* of the body 2 of the connector are bent towards the plane of the base surface 2*a* and then again in said plane, so as to define rear end portions 3*b* extending parallel to each other in the plane of said base surface 2*a* (see FIG. 9). When this condition is reached, a cutting operation of the portions in excess of the rear ends of the contact can be carried out (FIG. 2 and FIG. 10).

In the final condition thus reached, each metal contact has an intermediate portion 3*c*, extending outside of the rear surface 2*e* of the connector body in a direction orthogonal to the plane of the base surface of the connector body.

Figure 11:
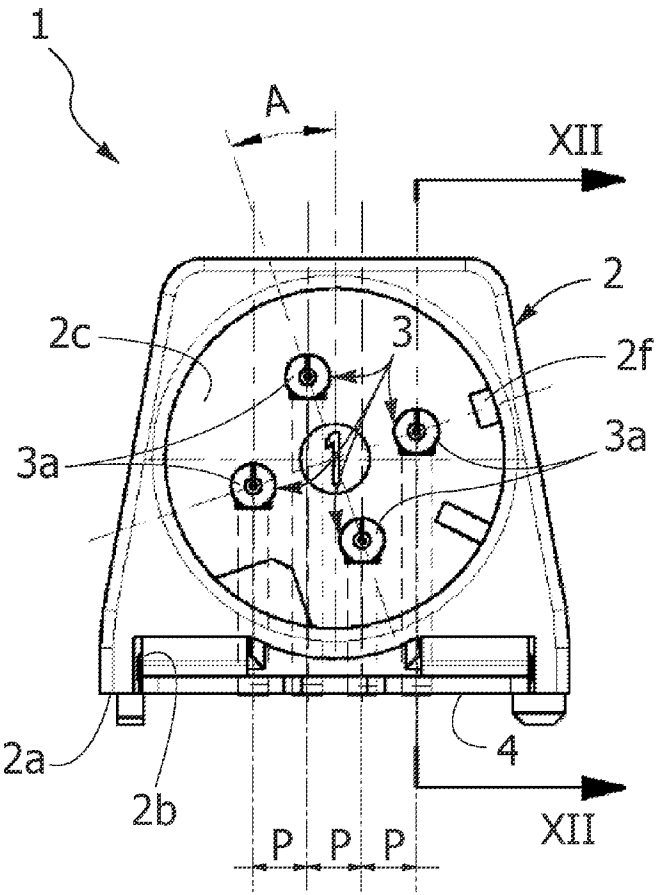
FIG. 11 is a front view of the body of the connector according to the invention.

As visible in FIG. 11, the front end portions 3*a* of the metal contacts 3 are equally angularly spaced apart in a circumferential arrangement oriented such that the projections of these end portions 3*a* over the plane of the base surface are equally spaced from each other along a transverse direction, parallel to the plane of the base surface and orthogonal with respect to the longitudinal direction of the contacts, with a constant pitch designated by P in FIG. 11, each of the four contact front portions being at a different distance from the base surface. This condition can be reached by arranging the four contacts at the apices of a theoretical square whose diagonals are inclined, with respect to the vertical or the horizontal direction (depending upon which diagonal is considered) by an angle A (FIG. 11) substantially corresponding to the arch tangent of ⅓, which with an approximation of 1/1000 is 18.435°. In the illustrated actual case, given the tolerances of manufacture, it has been considered a value of this angle of 18.45° as being acceptable. Due to this feature, the rear end portions 3*b* are transversely equally spaced apart from each other so as to be arranged in the best way to be coupled with respect conductive paths on the printed circuit board. In the case that the contacts 3 are in a number different from that shown, the value of the above mentioned angle would change accordingly, so as to always ensure the above mentioned condition of equal transverse distance between the rear ends 3*b* of the contacts to be met.

As visible in FIG. 11, the wall of the receptacle 2*d* has a tooth 2*f* which is elastically deformable, for engagement on a seat 5*b* provided on the outer surface of the female connector 5 in the coupling condition (FIG. 4).

Also with reference to FIG. 1, the body 2 of the connector has an upper surface 2*g* which is planar and favours the operation of picking up and placing the connector into operation by means of automated tools. Typically, according to a technique known per se, a plurality of connectors of the above indicated type are packaged, for use in a mass production, within packaging seats forming part of a single packaging strip which can be stored in form of a wound reel and having a removable adhesive strip which closes the packaging seats.

Naturally, while the principle of the invention remains the same, the details of construction and the embodiments may widely vary with respect to what has been described and shown purely by way of example, without departing from the scope of the present invention.

The invention claimed is:

1. Electric surface mount device (SMD) male connector, comprising:

a body of plastic material, having a substantially planar base lower wall, to which a metal plate is associated for a soldered connection to a board of a printed circuit, a plurality of metal contacts, carried by the body of the connector having front end portions, for mating with the contacts of a female connector, said front end portions projecting from a front surface of the body of the connector, parallel to, and spaced apart from, said base lower surface, and rear end portions which project form a rear surface of the body of the connector, in a plane substantially coincident with the plane of said base lower surface and along directions parallel to each other, wherein said front end portions of the metal contacts are equally angularly spaced along a circumference and are oriented so that the front portions of every contact of the connector is at a different distance from the base lower surface and so that theoretical projections of said front portions of the contacts on the plane of said lower surface are substantially equally spaced apart from each other, whereby said rear end portions of the metal contacts are also equally spaced apart from each other.

2. Connector according to claim 1, wherein the metal contacts are constituted by bent sheet metal elements arranged in parallel and equally spaced planes orthogonal to said base lower surface and each including an intermediate portion connecting the front end portions to the rear end portion.

3. Connector according to claim 1, wherein each metal contact is constituted by a planar and elongated strip of sheet metal and in that the front end portion of each contact has the configuration of a cylindrical pin, obtained by transversely bending and forming the front portion of said strip.

4. Connector according to claim 1, wherein the body of the connector includes a wall whose opposite surfaces define said front surface and said rear surface, said wall having a plurality of through apertures for engagement by said metal contacts, so that each contact has a pin-shaped front end portion which is in abutment against a stop surface of said wall and extends further into said intermediate portion through the respective through aperture until it exits on the rear surface of the connector body, where the body of the metal contact is bent towards the lower surface of the body of the connector, and then in the plane of said lower surface, so as to define said rear end portion of the contact.

5. Connector according to claim 1, wherein the front end portions of said metal contacts extend from a bottom surface of a receptacle formed at the front of the body of the connector.

6. Connector according to claim 5, wherein the pin-shaped front end portion of each contact is held by friction, with an interference fit, within a respective seat, against said stop surface.

7. Connector according to claim 1, wherein the metal contacts are four in number and, viewed from the front, are at the corners of a theoretical square whose diagonal are inclined, with respect either to a vertical or a horizontal direction, by an angle substantially corresponding to the arch tangent of ⅓.

8. Connector according to claim 7, wherein said angle (A) is 18.45°.

9. Method for assembling an electric surface mount device (SMD) male connector, comprising:

providing a body of plastic material, having a substantially planar base lower wall, and associating a metal plate to said base lower wall, for soldered connection to a board of a printed circuit, wherein said body of the connector includes a wall whose opposite surfaces define a front surface and a rear surface of the connector, said wall of the connector being formed with a plurality of through apertures, providing a plurality of metal contacts originally in form of planar and straight strips of sheet metal, transversely bending and shaping front end portions of said strips so as to give them the configuration of cylindrical pins, inserting each of said contacts through a respective one of said through apertures in the body of the connector, starting from a side of the front surface, using rear end portions of the contacts as leading ends, until the front end portions are brought into abutment against respective stop surfaces, with the rear portions projecting through said through apertures from the rear surface of the body of the connector, the portions of the contacts projecting from the rear surface of the connector are then bent towards the lower surface of the body of the connector, and then in a plane substantially coincident with the plane of said lower surface, so as to define the rear end portions of the contacts of the connector, wherein said through apertures are formed in the connector body at positions equally angularly spaced along a circumference, and oriented so that each of the apertures of the connector body is at a different distance from the base lower surface and that the theoretical projections of said apertures on the plane of said lower surface are substantially equally spaced apart from each other, whereby said rear end portions of the metal contacts are also obtained equally spaced apart from each other.

* * * * *